US008207849B2

(12) United States Patent
Belden, Jr. et al.

(10) Patent No.: US 8,207,849 B2
(45) **Date of Patent: *Jun. 26, 2012**

(54) SECURITY STORAGE CONTAINER HAVING AN INTERNAL ALARM

(75) Inventors: Dennis D. Belden, Jr., Canton, OH (US); Nicholas M. Sedon, Weddington, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/051,464

(22) Filed: Mar. 18, 2011

(65) Prior Publication Data

US 2011/0210852 A1 Sep. 1, 2011

Related U.S. Application Data

(63) Continuation of application No. 12/573,235, filed on Oct. 5, 2009, now Pat. No. 7,924,154, which is a continuation of application No. 11/640,620, filed on Dec. 18, 2006, now Pat. No. 7,598,861.

(60) Provisional application No. 60/757,070, filed on Jan. 6, 2006.

(51) Int. Cl.
*G08B 13/08* (2006.01)

(52) U.S. Cl. ..... 340/545.6; 340/568.1; 340/540; 340/546; 116/86; 348/155; 348/152

(58) Field of Classification Search ..... None
See application file for complete search history.

(56) References Cited

U.S. PATENT DOCUMENTS

| | | | | |
|---|---|---|---|---|
| 806,768 | A | 12/1905 | Bauer | |
| 3,493,955 | A | 2/1970 | Minasy | |
| 3,590,614 | A | 7/1971 | Kunst | |
| 4,117,468 | A | 9/1978 | Vasquez | |
| 4,153,178 | A | 5/1979 | Weavers | |
| 4,155,079 | A | 5/1979 | Chiu et al. | |
| 4,204,202 | A | 5/1980 | Pai | |
| 4,469,225 | A | 9/1984 | Takahashi | |
| 4,573,042 | A | 2/1986 | Boyd et al. | |
| 4,620,644 | A | 11/1986 | Miller | |
| 4,686,513 | A | 8/1987 | Farrar et al. | |
| 4,788,533 | A | 11/1988 | Mequignon | |
| 4,800,369 | A | 1/1989 | Gomi et al. | |
| 4,805,769 | A | 2/1989 | Soltis et al. | |
| 4,851,815 | A | 7/1989 | Enkelmann | |
| 4,853,692 | A | 8/1989 | Wolk et al. | |
| 4,966,020 | A | 10/1990 | Fotheringham et al. | |
| 4,980,671 | A | 12/1990 | McCurdy | |
| 5,005,125 | A | 4/1991 | Farrar et al. | |
| 5,051,725 | A * | 9/1991 | Caccitolo | 340/571 |

(Continued)

FOREIGN PATENT DOCUMENTS

| | | |
|---|---|---|
| EP | 0308810 | 3/1989 |

(Continued)

*Primary Examiner* — Travis Hunnings
(74) *Attorney, Agent, or Firm* — Sand & Sebolt

(57) ABSTRACT

A security storage container securely retains an item of merchandise and typically includes a base and lid. An alarm system in the container is activated when the container is locked and deactivated when the container is unlocked. The alarm system may include a flashing LED, an EAS tag for activating a security gate, and a sound-emitting device which may emit a loud alarm upon an attempt to pry the lid from the base or upon the container entering into proximity of a security gate.

37 Claims, 10 Drawing Sheets

U.S. PATENT DOCUMENTS 5,087,908 A 2/1992 Sanders
5,126,719 A 6/1992 DeSorbo
5,147,034 A 9/1992 Broadhead et al.
5,149,153 A 9/1992 Drewry et al.
5,153,561 A * 10/1992 Johnson ..... 340/571
5,182,543 A 1/1993 Siegel et al.
5,205,401 A 4/1993 Weisburn et al.
5,209,086 A 5/1993 Bruhwiler
5,211,283 A 5/1993 Weisburn et al.
5,245,317 A 9/1993 Chidley et al.
5,276,588 A 1/1994 Repplinger et al.
5,367,289 A 11/1994 Baro et al.
5,368,162 A 11/1994 Holmgren
5,375,712 A 12/1994 Weisburn
5,479,341 A 12/1995 Pihl et al.
5,481,245 A * 1/1996 Moldavsky ..... 340/540
5,524,752 A 6/1996 Mazzucchelli
5,570,080 A 10/1996 Inoue et al.
5,588,315 A 12/1996 Holmgren
5,589,819 A 12/1996 Takeda
5,598,728 A 2/1997 Lax
5,610,587 A 3/1997 Fujiuchi et al.
5,636,535 A 6/1997 Shimada
5,640,144 A 6/1997 Russo et al.
5,656,998 A 8/1997 Fujiuchi et al.
5,680,782 A 10/1997 Komatsu et al.
5,730,283 A 3/1998 Lax
5,760,689 A 6/1998 Holmgren
5,762,187 A 6/1998 Belden, Jr. et al.
5,764,147 A 6/1998 Sasagawa et al.
5,767,773 A 6/1998 Fujiuchi et al.
5,768,922 A 6/1998 Lax
5,793,290 A 8/1998 Eagleson et al.
5,808,548 A 9/1998 Sasagawa et al.
5,838,234 A 11/1998 Roulleaux-Robin
5,864,290 A 1/1999 Toyomi et al.
5,904,246 A 5/1999 Weisburn et al.
5,944,185 A 8/1999 Burdett et al.
5,944,396 A 8/1999 Stephan
5,955,951 A 9/1999 Wischerop et al.
5,982,283 A 11/1999 Matsudaira et al.
5,988,376 A 11/1999 Lax
6,020,819 A 2/2000 Fujiuchi et al.
6,037,879 A 3/2000 Tuttle
6,043,744 A 3/2000 Matsudaira
6,104,285 A 8/2000 Stobbe
6,118,367 A 9/2000 Ishii
6,125,668 A 10/2000 Belden, Jr.
6,135,280 A 10/2000 Burdett et al.
6,137,414 A 10/2000 Federman
6,144,299 A 11/2000 Cole
6,225,903 B1 * 5/2001 Soloway et al. ..... 340/542
6,255,951 B1 7/2001 De La Huerga
6,304,181 B1 10/2001 Matsudaira
6,346,886 B1 2/2002 De La Huerga
6,420,971 B1 7/2002 Leck et al.
6,422,387 B1 7/2002 Sedon et al.
6,433,689 B1 8/2002 Hovind et al.
6,474,117 B2 11/2002 Okuno
6,512,457 B2 1/2003 Irizarry et al.
6,531,961 B2 3/2003 Matsudaira
6,535,130 B2 3/2003 Nguyen et al.
6,646,554 B1 11/2003 Goff et al.
6,666,330 B2 12/2003 Sedon et al.
6,726,019 B2 * 4/2004 Leung ..... 206/769
6,961,000 B2 11/2005 Chung
7,102,509 B1 9/2006 Anders et al.
7,116,233 B2 10/2006 Zhurin
7,222,745 B2 5/2007 Gutierrez et al.
7,403,118 B2 7/2008 Belden, Jr.
7,598,861 B2 * 10/2009 Belden et al. ..... 340/545.6
7,924,154 B2 * 4/2011 Belden et al. ..... 340/545.6
2004/0163977 A1 8/2004 Sedon et al.
2005/0268672 A1 12/2005 Fraser et al.
2006/0170550 A1 * 8/2006 Marsilio et al. ..... 340/568.2

FOREIGN PATENT DOCUMENTS

EP 0616103 9/1994
FR 2628717 9/1989
FR 2722028 1/1996
JP 8279082 10/1996

* cited by examiner

SECURITY STORAGE CONTAINER HAVING AN INTERNAL ALARM

CROSS REFERENCE TO RELATED APPLICATIONS

This application is a continuation of U.S. patent application Ser. No. 12/573,235, filed Oct. 5, 2009, which is a continuation of U.S. patent application Ser. No. 11/640,620, filed Dec. 18, 2006, now U.S. Pat. No. 7,598,861, which claims priority from U.S. Provisional Application Ser. No. 60/757,070 filed Jan. 6, 2006; the disclosures of which are incorporated herein by reference.

BACKGROUND OF THE INVENTION

1. Technical Field

This invention generally relates to security devices. More particularly, the invention relates to a lockable storage container for holding an item of merchandise for sale. Specifically, the invention relates to a storage container which has a locking mechanism that secures the item of merchandise within the container; and which has an internal alarm system that will trigger a remote alarm on a security gate and will emit an internal audible sound if the container is opened in an unauthorized manner or if it is brought into the vicinity of a security gate without first being disarmed.

2. Background Information

The invention relates to electronic security devices and security systems, and in particular, to a security storage container for holding articles of merchandise to prevent unauthorized removal of the merchandise from the security storage container and from a protected environment. More particularly, the invention relates to a security storage container for retaining merchandise that will sound an alarm if an attempt is made to remove the merchandise from the security storage container, which will sound the alarm upon the storage container approaching a security gate and will actuate the security gate alarm if the security storage container is not deactivated before exiting the protected environment.

Various retail establishments use numerous types of theft deterrent devices and systems to discourage shoplifting. One common theft deterrent system uses electronic article surveillance tags (EAS tags) attached to the items of merchandise. These EAS tags are configured to activate an alarm at a security gate that is positioned usually at the exit of the establishment if the merchandise containing the EAS tag passes through the secured gate before being removed or deactivated at a checkout station. Other security devices contain an internal alarm which activates an audible alarm within the device if an item of merchandise containing an EAS tag is attempted to be removed from the device illegally. Although these various security devices perform satisfactorily for their intended purpose, they will only sound their self-contained alarm if a sense loop, such as a cable attached to the merchandise, is compromised. If the merchandise with the security device attached is taken through the security gates of the establishment, the gate alarm will sound, but the internal alarm of the security device will remain inactive. Thus, a thief can take merchandise containing the secured EAS tag and remain undetected until passing through a store's security gate. If the thief manages to evade security personnel after exiting through the security gate, they can easily disappear into a crowded parking lot or outside environment. The store's security personnel will know that an article of merchandise has been stolen, but will not be able to determine who the thief is. Furthermore, presently known security gate alarms also have sensitivity problems due to the large number of EAS tags placed on all of the different types of merchandise. The presence of these innumerable tags requires that the security gate alarms be activated at a particular sensitivity level and an unlawfully removed EAS tag may not be sensed at all times.

Thus, the need exists for an improved security storage container and security system which will provide multiple alarms to assist in deterring the theft of articles of merchandise contained within the security storage container. The storage container will sound an internal audible alarm if an attempt is made to remove merchandise from within the container prior to deactivation of the alarm system. The self-contained alarm will also sound if the security storage container approaches a security gate without being deactivated. Furthermore, the alarm system of the storage container will work in combination with a security gate of a protected establishment to sound the security gate alarm remote from the security storage container if the security storage container passes through the gate in an authorized manner. Furthermore, the self-contained alarm disposed in the security storage container will continue to sound even after the security storage container has passed through the security gate thereby enabling store personnel to detect the thief even in a crowded outside environment.

SUMMARY OF THE INVENTION

The present invention provides a security container for retaining an item of merchandise therein, said container comprising: a frame adapted to retain therein an item of merchandise and comprising a base and a lid mounted on the base and movable between an open position for allowing insertion and removal of the item to and from the frame and a closed position for preventing removal of the item from the frame; an alarm carried by the frame; and a slider mounted on the frame and movable relative to the base and lid between a first position which prevents the base and lid from moving from the closed position to the open position and a second position which allows the base and lid to move from the closed position to the open position; wherein movement of the slider causes the alarm to be armed.

The present invention also provides a security container for retaining an item of merchandise therein, said container comprising: a frame adapted to retain therein an item of merchandise and comprising a base and a lid mounted on the base and movable between an open position for allowing insertion and removal of the item to and from the frame and a closed position for preventing removal of the item from the frame; an electric circuit carried by the frame; a first switch carried by the frame; and a slider mounted on the frame and movable relative to the base and lid between a first position which prevents the base and lid from moving from the closed position to the open position and a second position which allows the base and lid to move from the closed position to the open position; wherein movement of the slider causes the first switch to move to a position which closes or breaks the electrical circuit.

The present invention further provides a security container for retaining an item of merchandise therein, said container comprising: a frame adapted to retain therein an item of merchandise and comprising a base and a lid mounted on the base and movable between an open position for allowing insertion and removal of the item to and from the frame and a closed position for preventing removal of the item from the frame; a slider mounted on the lid and movable relative to the base and lid between a first position which prevents the base and lid from moving from the closed position to the open position and a second position which allows the base and lid to move from the closed position to the open position; and an alarm system between the slider and the lid.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 16:
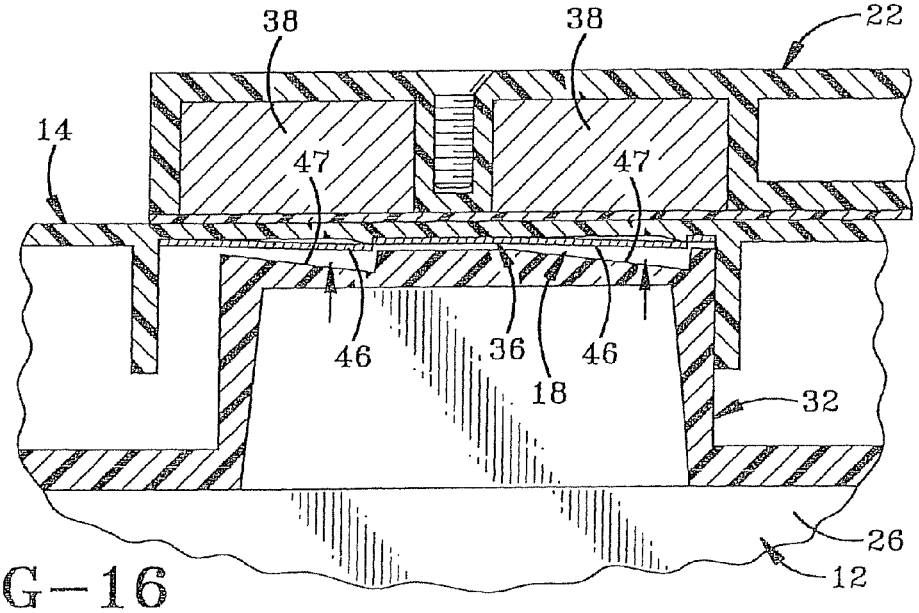
FIG. 16 is a partial cross-sectional side view of the lid being engaged by a magnetic key to unlock the locking mechanism.

Referring to FIGS. 1-16, there is shown a security storage container in accordance with the present invention and generally indicated at 10. Security storage container 10 is in the form of a six-sided box having a base 12 and a lid 14 that is connected to base 12 and is movable between open and closed positions. Base 12 is sized to receive an item of merchandise (not shown) and lid 14 cooperates with base 12 to surround and secure the item of merchandise when lid 14 is in the closed position. Lid 14 preferably is pivotally mounted to base 12 by way of a hinge 16. As will be hereinafter described, security storage container 10 also includes a locking mechanism, generally indicated at 18 (FIG. 8), for securing lid 14 and base 12 together and preventing the unauthorized removal of the item of merchandise from within base 12. Security storage container 10 also includes an alarm system, generally indicated at 20. Alarm system 20 may include a light, such as an LED 82, to indicate that container 10 is armed, an EAS tag 84, and a sound emitting speaker 80. One or more of the components of alarm system 20 are triggered when an attempt is made to pry lid 14 off base 12, is brought into the proximity of a security gate of a store or if container 10 is removed from the store without prior deactivation of system 20 with a specially designed key 22 (FIG. 16). Security storage container 10 with its integral alarm system 20 is designed to be used as part of a security system for merchandise such as the system disclosed and claimed in pending U.S. application Ser. No. 11/312,266, filed Dec. 20, 2005, and entitled "Electronic Security Device and System for Articles of Merchandise", which application claimed priority from U.S. Provisional Application Ser. No. 60/639,770, filed Dec. 28, 2004. The entire specifications of these two applications are incorporated herein by reference.

Storage container 10 is adapted to receive items of merchandise such as CD or DVD packages or may be configured to hold other items of merchandise such as computer software boxes, books, jewelry boxes, electronics boxes and the like. Base 12 is typically manufactured from a transparent material that allows the customer to view the item of merchandise held within storage container 10. Base 12 has a front wall 24, back wall 26, and opposing left and right side walls 28 which extend upwardly and outwardly away from a bottom wall 30. Walls 24, 26, 28 and 30 are disposed in the form of a five-sided frame or box having an open end disposed opposite bottom wall 30.

Lid 14 is pivotally connected to base 12 by hinges 16 which are rotatable about hinge-pins 16*a*. Lid 14 closes the open end of the box when lid 14 is in the closed position and allows access to the interior cavity of the box when lid 14 is in the open position. Lid 14 preferably is manufactured from an opaque material so that an observer cannot determine if an EAS tag is present within lid 14 and also cannot view the various components of the locking mechanism for securing storage container 10 in a closed and locked position. Lid 14 is locked to base 12 by any suitable locking mechanism including mechanically-actuated devices and magnetically actuated devices. However, an example of a suitable locking mechanism is the mechanism shown and described in pending U.S. patent application Ser. No. 10/371,570, filed Dec. 21, 2003. The entire specification of application Ser. No. 10/371,570 is incorporated herein by reference.

Figure 8:
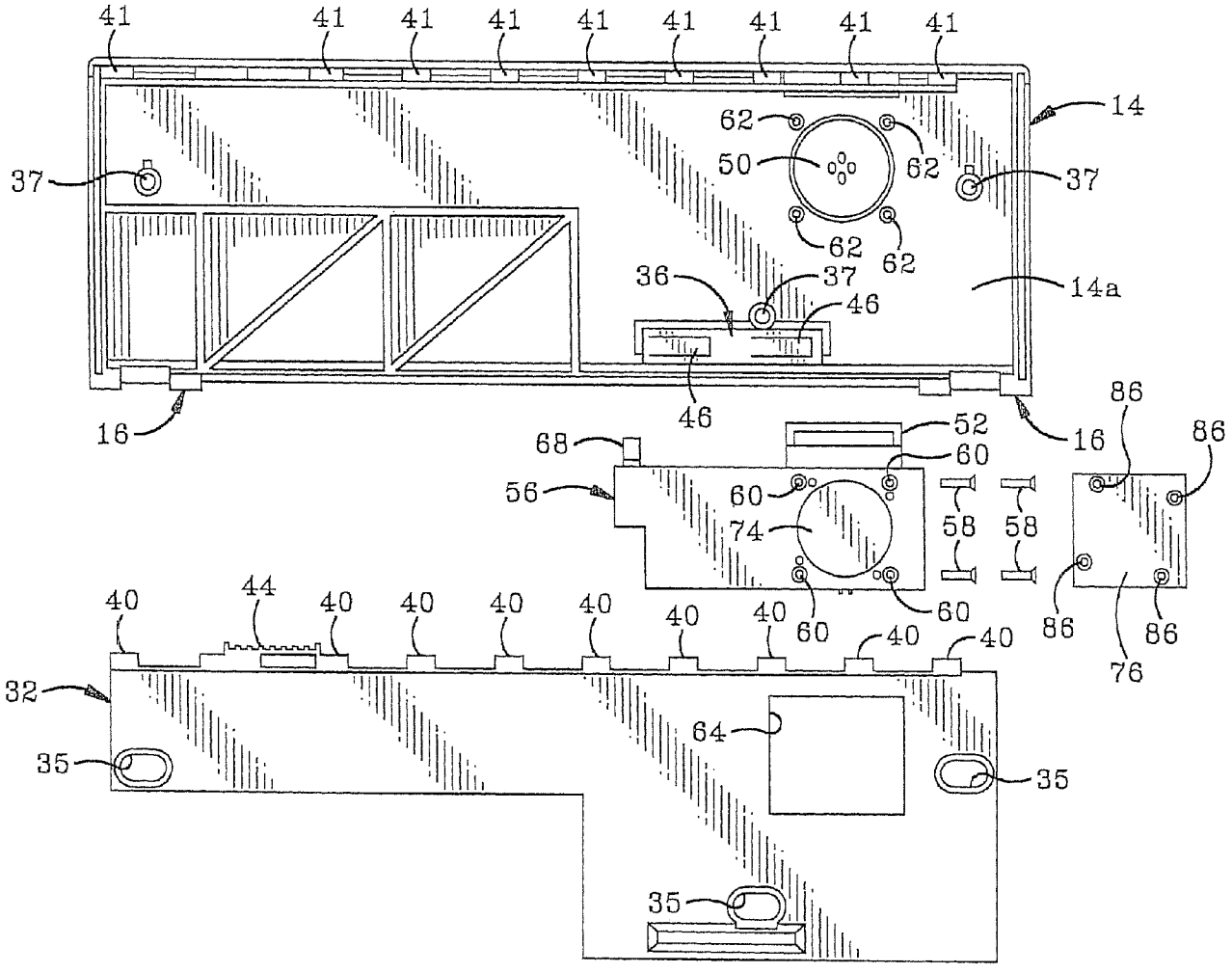
FIG. 8 is an exploded view of the lid.
Figure 9:
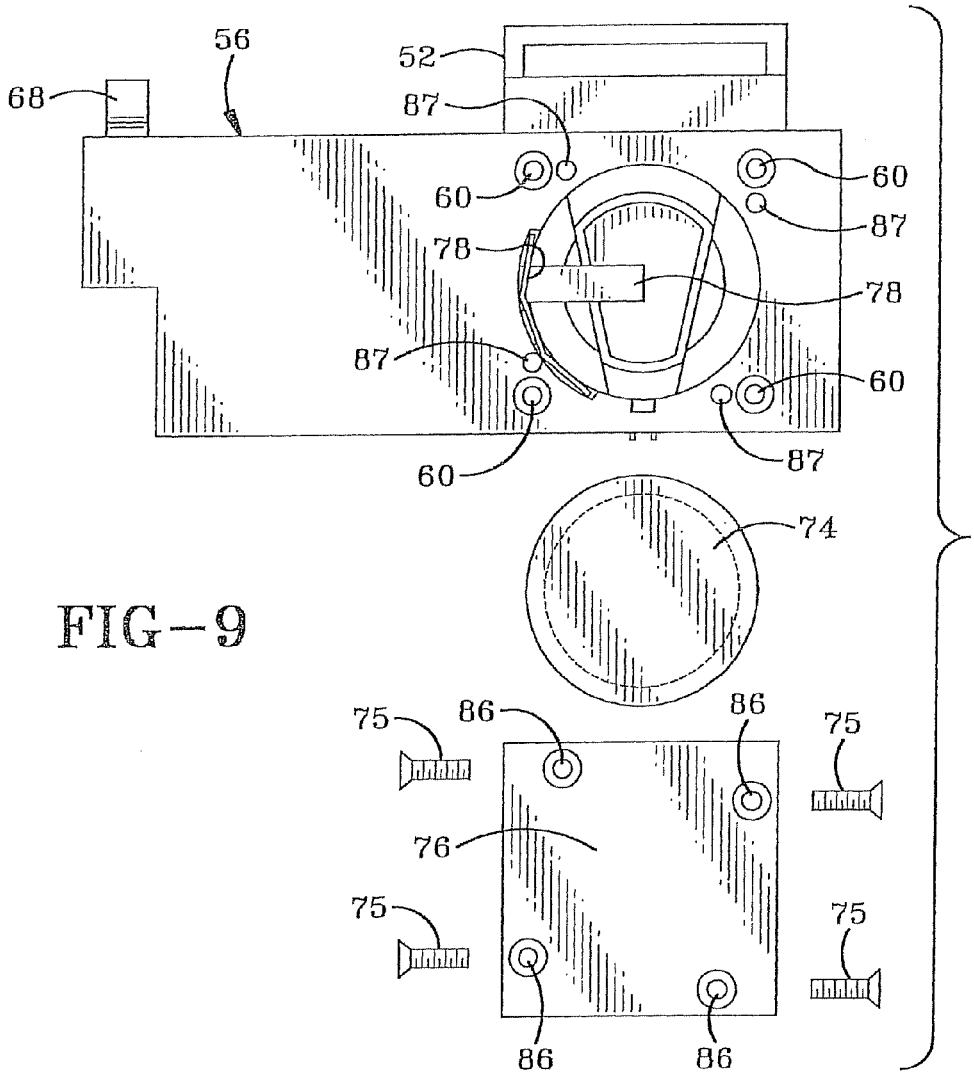
FIG. 9 is an exploded view of the battery holder assembly.
Figure 10:
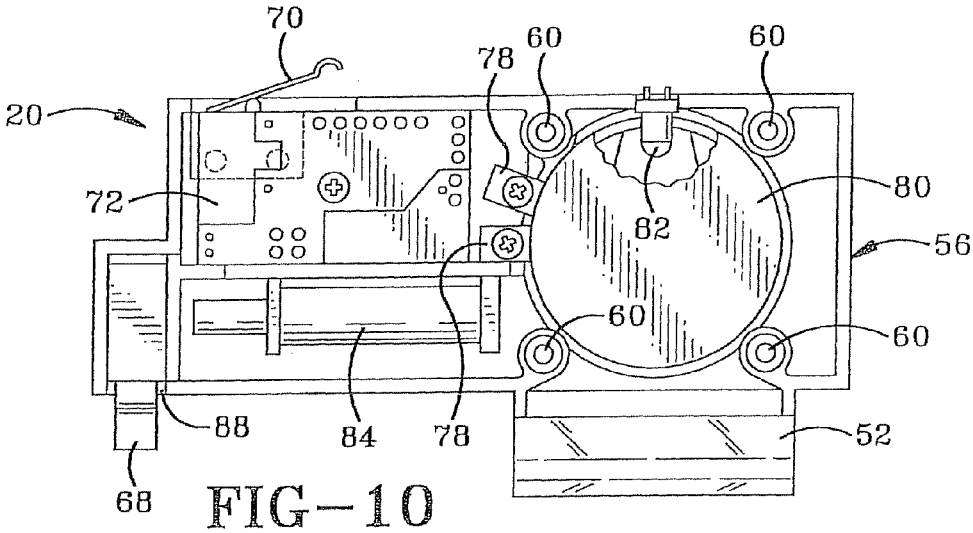
FIG. 10 is top view of the battery holder assembly.
Figure 11:
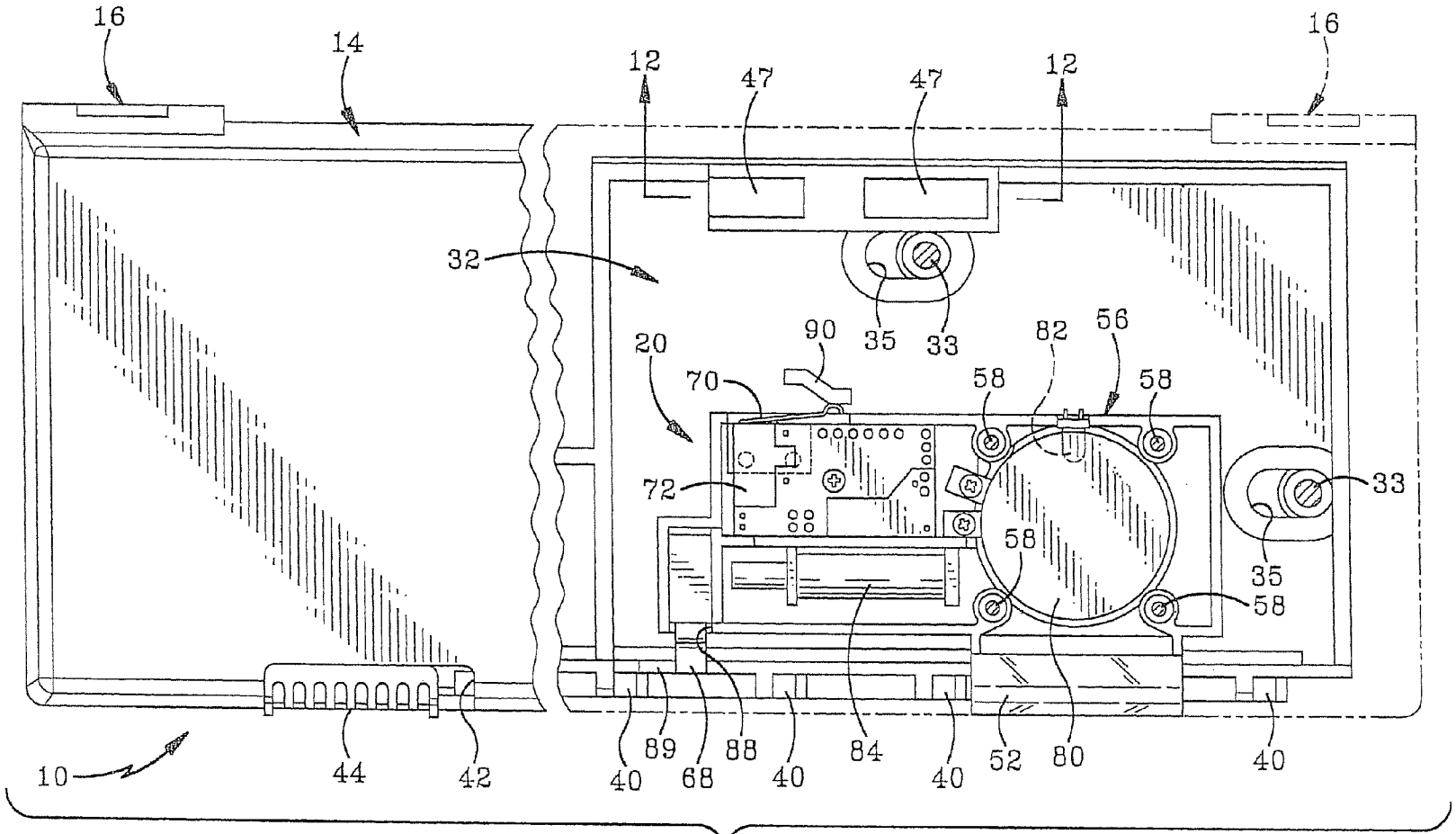
FIG. 11 is a partial cut-away top view of the lid.
Figure 12:
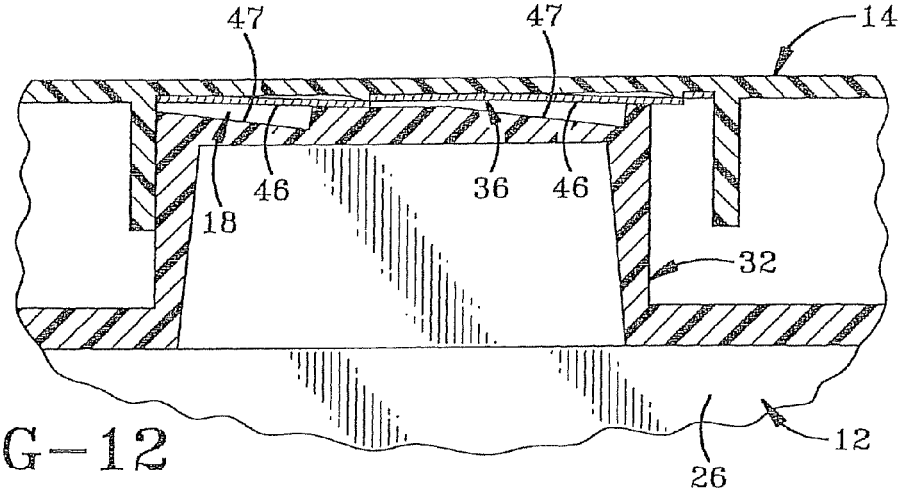
FIG. 12 is a partial cross-sectional front view of the lid and slider in an unlocked position as taken through line 12-12 of FIG. 11.

Lid 14 is locked to base 12 by a slider 32, which is slidably secured to an interior surface 14*a* of lid 14, and by a locking mechanism 18 (FIG. 8). Slider 32 is slidably secured to lid 14 by a plurality of fasteners 33 which are received through slots 35 in slider 32 and into bosses 37 formed in the interior surface 14*a* of lid 14. Slider 32 is selectively slidable relative to the interior surface 14*a* of lid 14 and is moveable between locked and unlocked positions. Locking mechanism 18 comprises a magnetically actuated locking arm 36 that has two spring-biased moveable fingers 46. Arm 16 and fingers 46 are designed to engage a portion of slider 32 that includes angled pockets 47. Pockets 47 are sized and shaped to receive fingers 46 therein and to prevent the withdrawal of the same therefrom unless the fingers 46 are acted upon by the magnetic key 22. Locking mechanism 18 holds slider 32 in the locked position when locking mechanism 18 is in its locked position, i.e., when fingers 46 are retained within pockets 47. Locking fingers 46 may be moved from the locked position (FIG. 14) to an unlocked position (FIGS. 12 & 16) by using key 22. Key 22 has magnets 38 disposed so as to align with the fingers 46 on locking arm 36 when key 22 is correctly positioned on lid 14. Magnets 38 attract fingers 46 toward them and, once fingers 46 are realigned with locking arm 36, the user can manipulate the finger tab 44 and slide slider 32 back into the open position. It will be understood that locking mechanism 18 may be carried by either lid 14 or slider 32 and may engage pockets 47 formed on the other of lid 14 and slider 32 depending on the particular design of locking mechanism 36.

Figure 1:
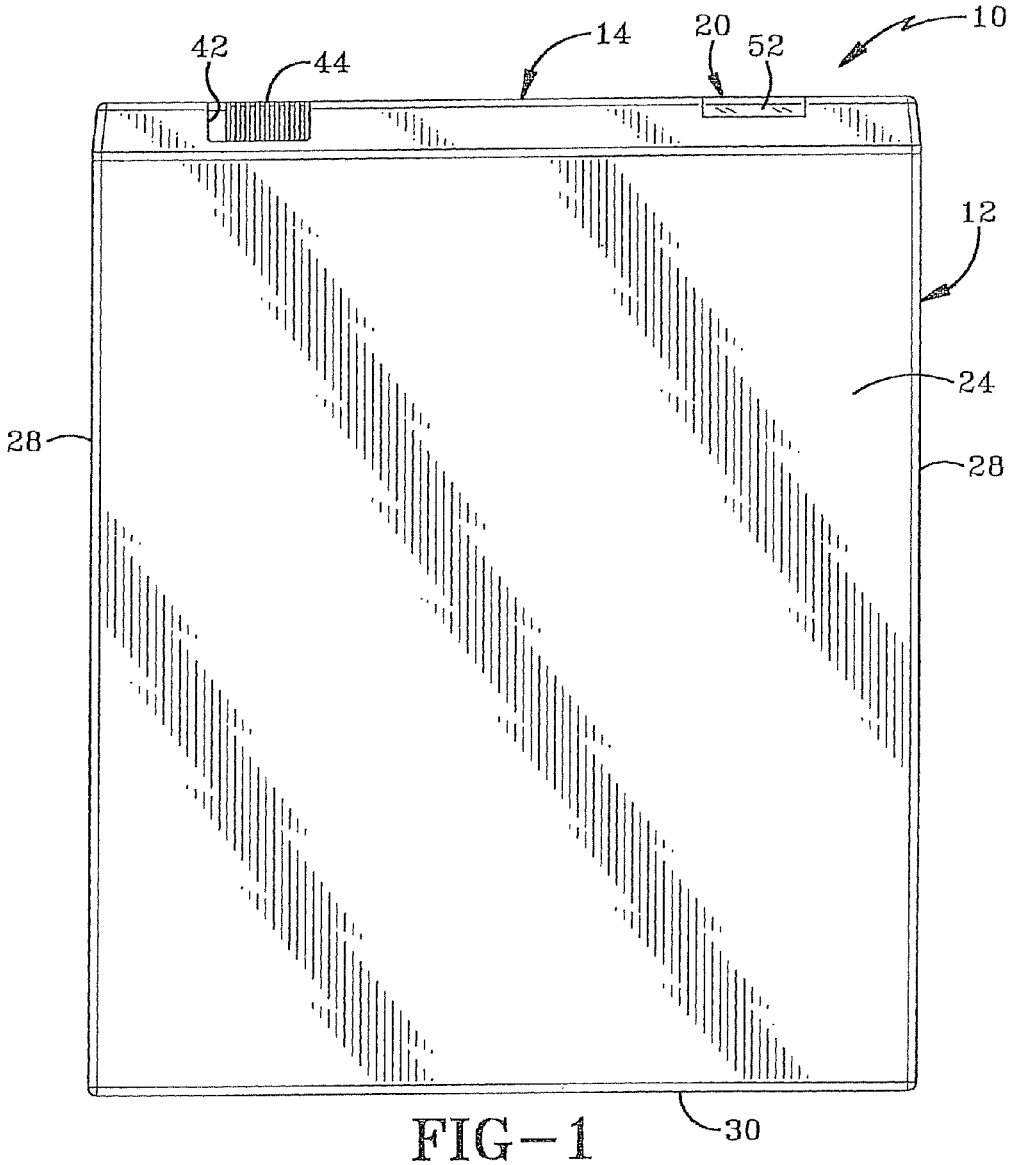
FIG. 1 is a front plan view of the security storage container of the present invention.
Figure 2:
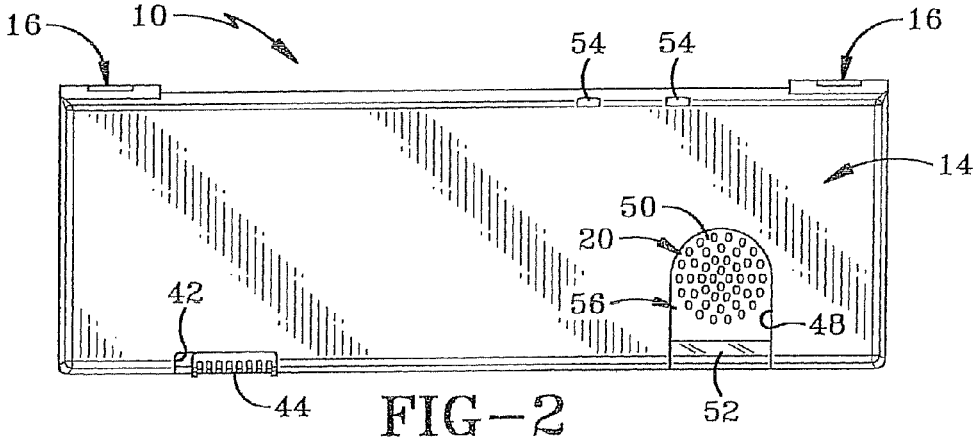
FIG. 2 is a top view of the security storage container.
Figure 3:
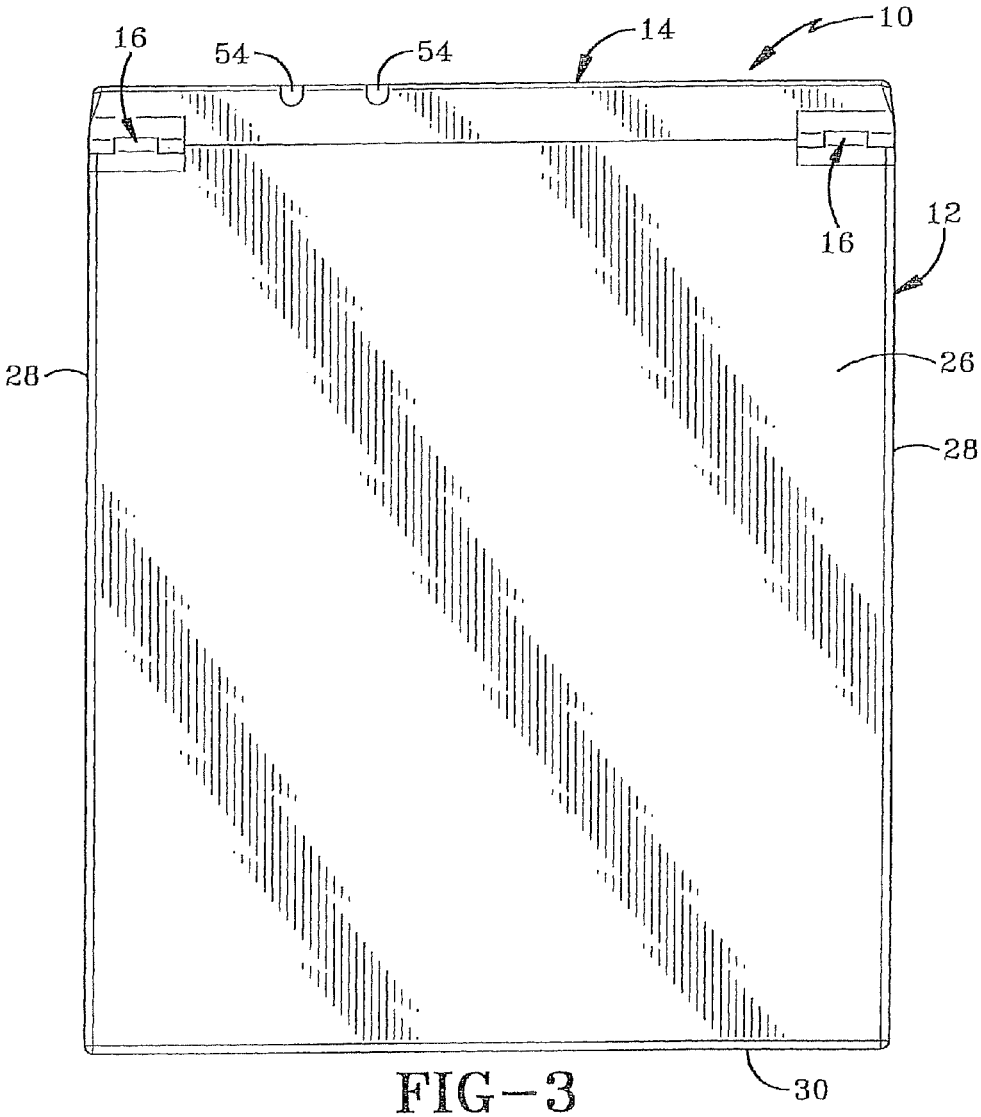
FIG. 3 is a rear plan view of the security storage container.
Figure 5:
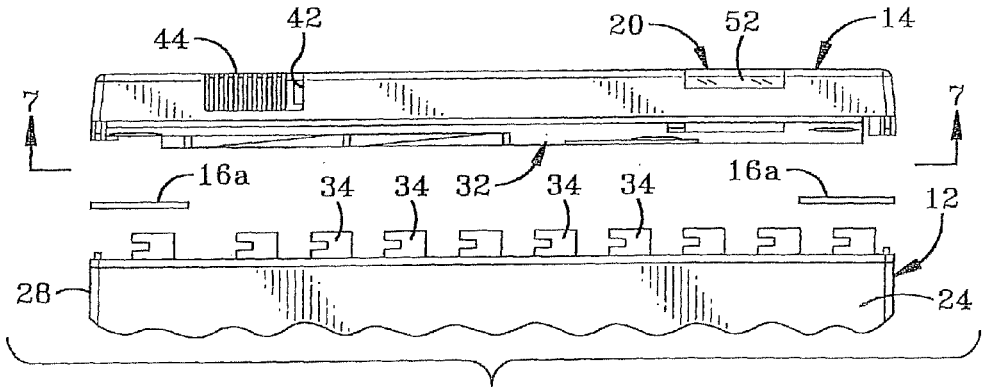
FIG. 5 is a partial front view of the upper end of the storage container showing the hinge connection between the storage container and the lid.
Figure 4:
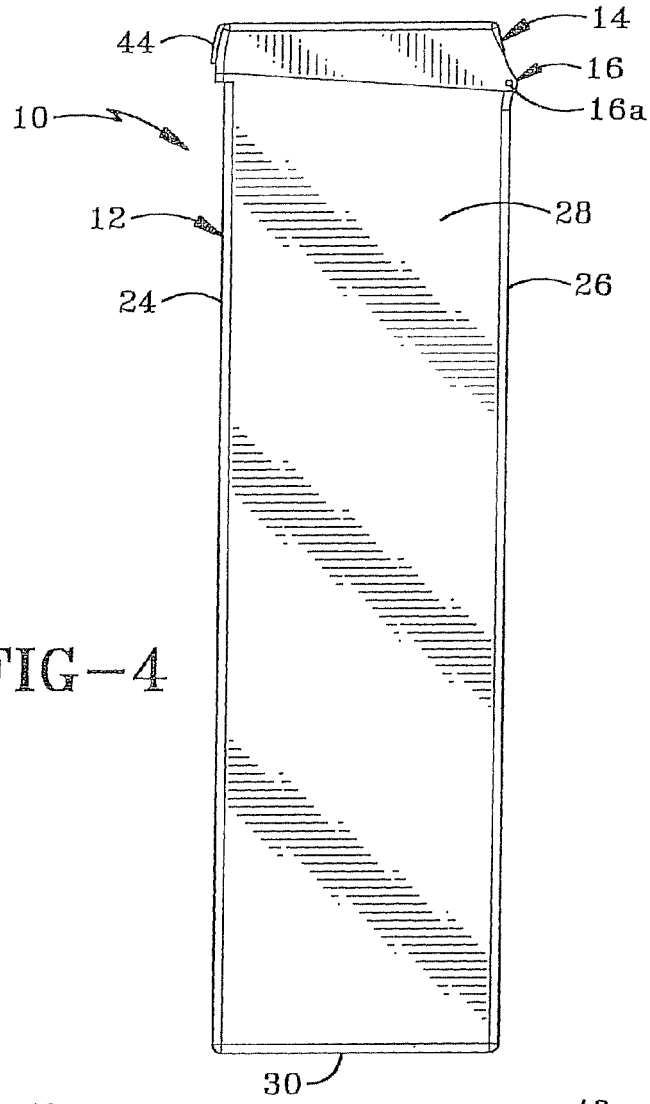
FIG. 4 is a right side view of the security storage container.
Figure 6:
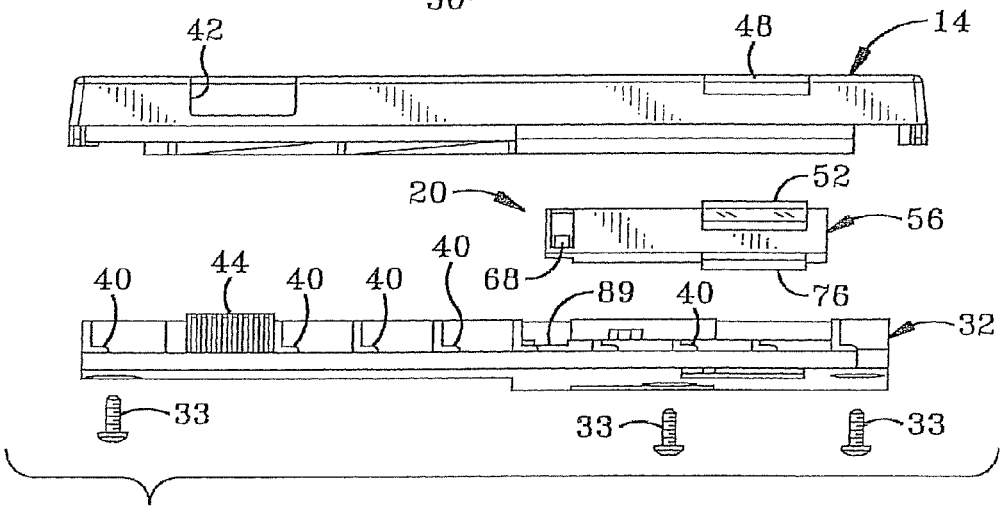
FIG. 6 is an exploded front view of the lid.
Figure 7:
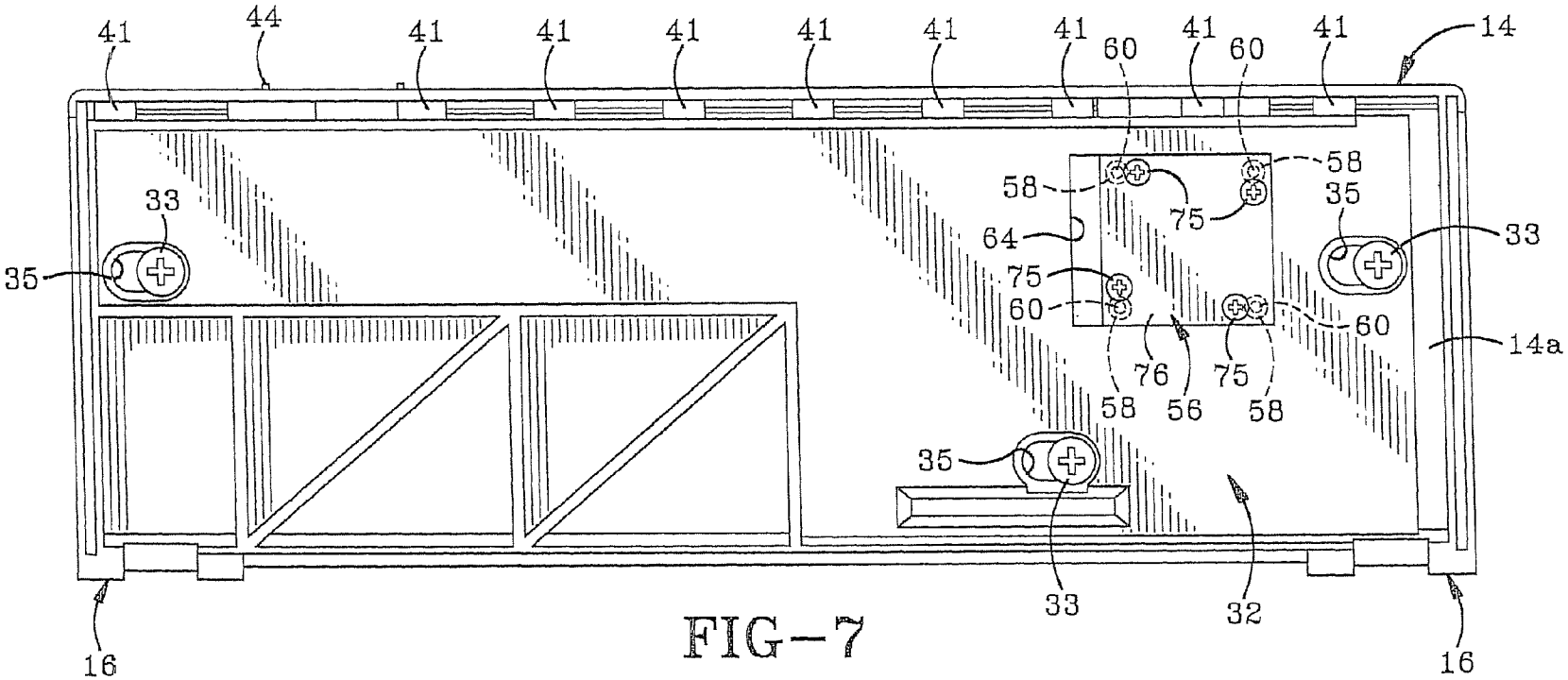
FIG. 7 is a bottom view of the lid.

Slider 32 includes a plurality of spaced L-shaped lock tabs 40 which are shown in FIGS. 6 and 8. Lid 14 includes a plurality of spaced apart tabs 41 which may be seen in FIGS. 7 and 8. Furthermore, the front wall 24 of base 12 includes a plurality of spaced-apart hook tabs 34 which extend upwardly and outwardly therefrom. Each hook tab 34 includes a U-shaped slot that lies substantially parallel to the upper edge of the front wall 24. Tabs 34, 40 and 41 are typically integrally fabricated with base 12, slider 32 and lid 14, respectively. When slider 32 is secured to lid 14, the lower leg of each of the L-shaped lock tabs 40 abuts an outer surface of one of the tabs 41. Hook tabs 34 and lock tabs 40 engage each other and disengage from each other when slider 32 is slidably moved between the locked and unlocked positions. When slider 32 is moved to lock lid 14 and base 12 together, the lower leg of each lock tab 40 slides along the upper surface of the associated tab 41 and into the U-shaped slot of the adjacent hook tab 34. This interlocking of lock tabs 34 and 40 substantially prevents lid 14 from being pivoted from a closed position to an open position and container 10 is therefore locked. When slider 32 is moved in the opposite direction, the lower legs of lock tabs 40 slide out of the U-shaped slot of the associated hook tab 34. Lid 14 is then in an unlocked state where it may be pivoted between a closed and an open position to allow access to the interior cavity in base 12.

Lid 14 is also provided with an aperture 48 which receives a speaker grille 50 and light post 52 of alarm system 20; and is furthermore provided with a pair of alignment indicators 54 which are used to correctly position key 22. Speaker grille 50 and light post 52 are integrally formed with a battery holder assembly 56 (FIG. 6) which is sandwiched between lid 14 and slider 32. Battery holder assembly 56 is fixedly connected to lid 14 by a plurality of fasteners 58 (FIG. 7) which extend through mounting holes 60 in assembly 56 and into bosses 62 (FIG. 8) which are integrally formed on interior surface 14*a* of lid 14.

Battery holder assembly 56 is provided with the circuitry and other components of alarm system 20. In particular, battery holder assembly includes at least a pair of switches 68, 70; a solid state circuit board 72 which substantially controls the alarm system; a battery 74 and associated battery cover 76, battery terminals 78; a speaker 80 (FIG. 10) a light-emitting diode (LED) 82 positioned to emit light toward light post 52; and the EAS tag and antenna 84. The LED 82 is designed to flash when alarm system 20 is activated. The EAS tag is Radio Frequency (RF) sensitive or magnetically sensitive (AM) and is designed to actuate a security gate alarm when it is detected by the security gate. Switch 68 extends outwardly through an opening 88 in battery holder assembly 56 and through a slot 89 (FIG. 6) in slider 32. Switch 70 extends outwardly from assembly 56 and into engagement with a projection 90 on slider 32. Battery cover 76 is secured to battery holder assembly 56 by a plurality of fasteners 75 which are inserted through holes 86 in cover 76 and into holes 87 (FIG. 9) in assembly 56. Slider 32 also includes an aperture 64 through which battery cover 76 extends for a short distance. Fasteners 75 may be easily accessed through aperture 64. As may be seen in FIG. 8, aperture 64 is smaller in length and width than battery holder assembly 56, but is wider than battery cover 76. The additional width of aperture 64 is provided so that as slider 32 moves back and forth, battery cover 76 is not engaged by slider 32.

Although not specifically shown in the attached figures, alarm system 20 also includes a plurality of sensors connected to circuit board 72. The sensors monitor the state of the electric circuit in the system and indicate when the circuit is broken. In the event of an interruption in the circuit, a signal is sent by the circuit board 72 to sound the internal audible alarm in the system.

Figure 14:
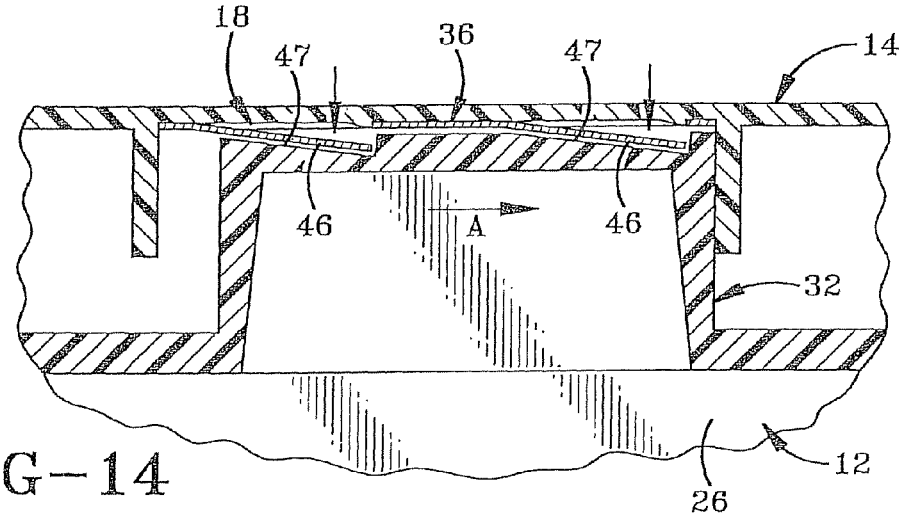
FIG. 14 is a partial cross-sectional front view of the lid and slider in a locked position as taken through line 14-14 of FIG. 13.
Figure 13:
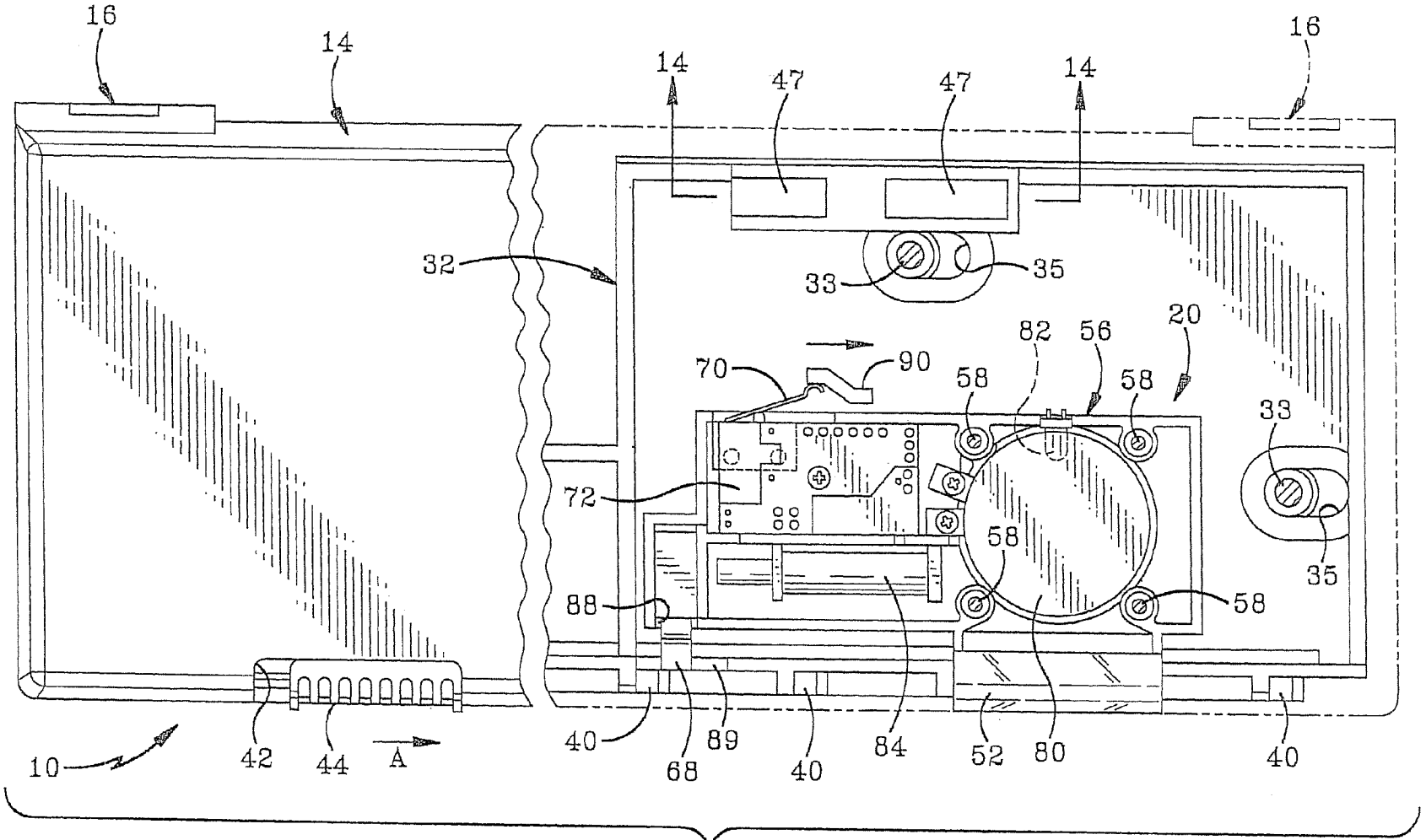
FIG. 13 is a partial cut-away top view of the lid in the unlocked position.
Figure 15:
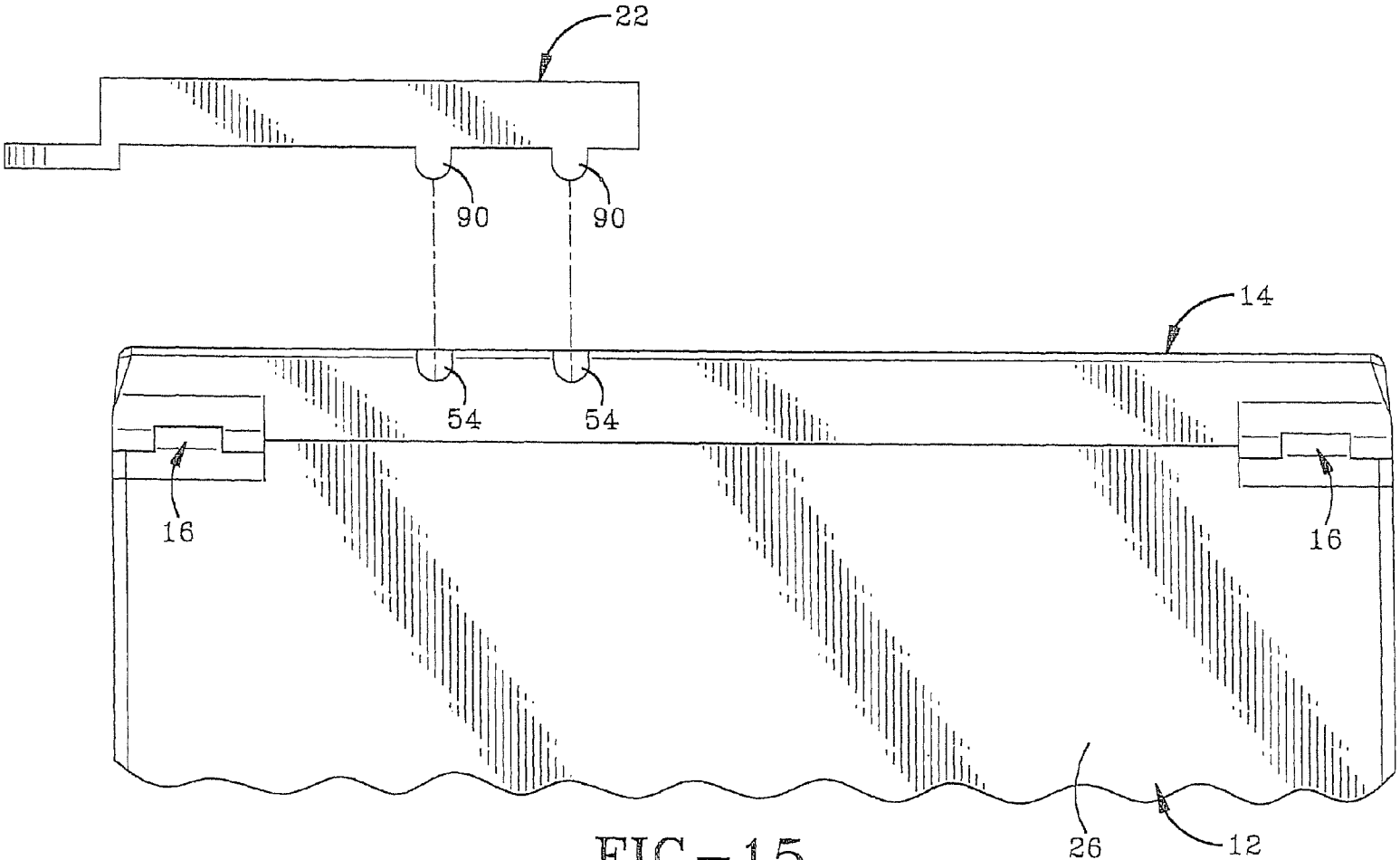
FIG. 15 is a partial cut-away top view of the lid in the locked position.

The security storage container 10 is used in the following manner. When locking mechanism 18 is in the unlocked position (FIGS. 11 & 12), lid 14 may be opened to allow for the insertion of an item of merchandise into base 12. Lid 14 is then rotated to close the open end of base 12. The user then pushes finger tab 44 in the direction of the arrow "A" (FIG. 13), causing the slider 32 to move in the direction of the arrow "A". As previously described, this movement causes lock tabs 40 and hook tabs 34 to engage each other. As shown in FIG. 14, movement of slider 32 also causes fingers 46 of lock arm 36 to slide into a position over pockets 47. Fingers 46 are spring biased into alignment with the planar lock arm 36. Consequently, when fingers 46 are disposed over pockets 47, they spring out of alignment with arm 36, become engaged in pockets 47 thereby further locking lid 14 and base 12 together. Furthermore, as shown in FIG. 13, movement of slider 32 causes switch 70 to ride along projection 90 thereby causing switch 70 to move into a position where the electric circuit in container 10 is closed. The movement of slider 32 also causes switch 68 to slide in opening 88 and slot 89 into a position where the electric circuit is closed. The closing of the electric circuit causes LED 82 to begin to emit light, that light being magnified and seen through light post 52 on lid 14. LED 82 indicates to the consumer that the container 10 is now alarmed. Preferably LED 82 is configured to blink so as to direct the consumer's attention to the fact that container 10 is alarmed. Furthermore, the closure of the circuit results in power being supplied to the EAS tag and to the speaker 80. Consequently, if any attempt is made to pry lid 14 from base 12, the sensors in alarm system 20 will be triggered and the speaker 80 will emit a loud, attention-getting sound. The container 10 can be preprogrammed to emit a sound for a predetermined length of time, such as 10 minutes for example. Furthermore, even if no attempt is made to pry lid 14 from base 12, if container 10 is brought within a certain preprogrammed range of a security gate at an entrance or exit of the protected environment, the EAS tag 84 will be triggered and thereby cause the security gates to sound a remote alarm. Simultaneously, the speaker 80 in container 10 will also begin to emit a loud, attention-getting sound. The alarm can only be switched off by engaging container with specially designed key 10.

In order to prevent the alarm system from being triggered after the merchandise has been legally purchased by the customer, container 10 has to be disarmed by aligning key 22 with locking mechanism 18. Key 22 is correctly aligned on container 10 by protrusions 90 (FIG. 15) on key 22 into apertures 54 on lid 14. This brings magnets 38 (FIG. 16) into the proximity of fingers 46 on locking mechanism 18. Fingers 46 are attracted toward magnets 38 and are thereby withdrawn from pockets 47 in base 32. The finger tab 44 may then be moved in the opposite direction to the arrow "A", thereby moving slider 32 in the opposite direction to the arrow "A" relative to lid 14. As slider 32 moves in this second direction, switch 70 slides along projection 90 from the position shown in FIG. 13 to the position shown in FIG. 11. Furthermore, switch 68 slides in the opposite direction through opening 88 and slot 89. The movement of switches 68 and 70 breaks the electric circuit in container 10, thereby disarming the alarm system 20. The movement of slider 32 in the opposite direction to the arrow "A" also causes lid 14 to be unlocked. Lid 14 can then be rotated into the open position and the item of merchandise may be removed from within base 12.

It will be understood that any type of EAS tag or RFID tag can be used in storage container 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security container for retaining an item of merchandise therein, said container comprising:

a frame adapted to retain therein an item of merchandise and comprising a base and a lid mounted on the base and movable between an open position for allowing insertion and removal of the item to and from the frame and a closed position for preventing removal of the item from the frame;

an alarm carried by the frame; and a slider mounted on the frame and movable relative to the base and lid between a first position which prevents the base and lid from moving from the closed position to the open position and a second position which allows the base and lid to move from the closed position to the open position; wherein movement of the slider causes the alarm to be armed.

2. The container of claim 1 wherein movement of the slider in a first direction causes the alarm to be armed; and movement of the slider in a second direction different from the first direction causes the alarm to be disarmed.

3. The container of claim 1 wherein movement of the slider causes the alarm to be disarmed.

4. The container of claim 1 further comprising a light carried by the frame; and wherein movement of the slider causes the light to begin to emit light.

5. The container of claim 1 further comprising an EAS tag carried by the frame; and wherein movement of the slider results in power being supplied to the EAS tag.

6. The container of claim 1 further comprising a speaker carried by the frame; and wherein movement of the slider results in power being supplied to the speaker.

7. The container of claim 1 further comprising an electric circuit carried by the frame; and a first switch carried by the frame; and wherein movement of the slider causes the first switch to move to a position which closes or breaks the electrical circuit.

8. The container of claim 7 further comprising a slot formed in the slider; and wherein the first switch extends through the slot.

9. The container of claim 1 wherein the slider is mounted on the lid; and the alarm is between the slider and the lid.

10. The container of claim 1 wherein the slider is mounted on the lid; and further comprising a battery between the slider and the lid.

11. The container of claim 10 further comprising a battery holder assembly between the slider and the lid; and wherein the battery is held by the assembly.

12. The container of claim 1 wherein the slider is mounted on the lid; and further comprising a speaker between the slider and the lid.

13. The container of claim 1 wherein the slider is mounted on the lid; and further comprising a light between the slider and the lid.

14. The container of claim 1 wherein the slider is mounted on the lid; and further comprising a circuit board between the slider and the lid.

15. The container of claim 1 wherein the slider is mounted on the lid; and further comprising an electric circuit between the slider and the lid, the electric circuit having a first switch.

16. The container of claim 1 further comprising a slot formed in the slider; and a fastener extending through the slot to slidably secure the slider to the frame.

17. The container of claim 1 further comprising an aperture formed in the slider; and a battery carried by the frame adjacent the aperture.

18. The container of claim 17 further comprising a battery cover which is adjacent the battery and extends into the aperture.

19. A security container for retaining an item of merchandise therein, said container comprising:

a frame adapted to retain therein an item of merchandise and comprising a base and a lid mounted on the base and movable between an open position for allowing insertion and removal of the item to and from the frame and a closed position for preventing removal of the item from the frame;

an electric circuit carried by the frame;

a first switch carried by the frame; and a slider mounted on the frame and movable relative to the base and lid between a first position which prevents the base and lid from moving from the closed position to the open position and a second position which allows the base and lid to move from the closed position to the open position; wherein movement of the slider causes the first switch to move to a position which closes or breaks the electrical circuit.

20. A security container for retaining an item of merchandise therein, said container comprising:

a frame adapted to retain therein an item of merchandise and comprising a base and a lid mounted on the base and movable between an open position for allowing insertion and removal of the item to and from the frame and a closed position for preventing removal of the item from the frame;

a slider mounted on the lid and movable relative to the base and lid between a first position which prevents the base and lid from moving from the closed position to the open position and a second position which allows the base and lid to move from the closed position to the open position; and an alarm system between the slider and the lid.

21. The container of claim 1 further comprising at least one screw which secures the alarm to the frame.

22. The container of claim 1 wherein the base comprises a bottom wall, a front wall, a back wall, a left side wall and a right side wall which together form a five-sided box having an open end opposite the bottom wall;

the base comprises a plurality of hook tabs secured to the front wall of the base;

the slider comprises a plurality of lock tabs which respectively engage the hook tabs in the first position and are disengaged from the hook tabs in the second position; and the lid is pivotally connected to the base by a hinge extending along the back wall of the base so that the lid pivots between the open and closed positions and covers the open end in the closed position.

23. The container of claim 1 wherein the base has a bottom wall, a front wall, a back wall, a left side wall and a right side wall which together form a five-sided box having an open end opposite the bottom wall;

the lid is pivotally connected to the base by a hinge extending along the back wall of the base so that the lid pivots between the open and closed positions and covers the open end in the closed position;

the slider is secured to the lid; and when the lid is in the closed position, the slider extends along the open end from adjacent the front wall of the base to adjacent the back wall of the base.

24. The container of claim 1 wherein the lid has a top wall, a front wall, a back wall, a left side wall and a right side wall;

the lid is pivotally connected to the base by a hinge extending along the back wall of the lid; and the slider extends from adjacent the front wall to adjacent the back wall.

25. The container of claim 1 wherein the lid has a top wall, a front wall, a back wall, a left side wall and a right side wall;

the lid is pivotally connected to the base by a hinge extending along the back wall of the lid; and the slider extends from adjacent the left side wall to adjacent the right side wall.

26. The container of claim 19 further comprising at least one screw which secures the electric circuit to the frame.

27. The container of claim 19 wherein the lid has a top wall, a front wall, a back wall, a left side wall and a right side wall;

the lid is pivotally connected to the base by a hinge extending along the back wall of the lid; and the slider extends from adjacent the front wall to adjacent the back wall.

28. The container of claim 19 wherein the lid has a top wall, a front wall, a back wall, a left side wall and a right side wall;

the lid is pivotally connected to the base by a hinge extending along the back wall of the lid; and the slider extends from adjacent the left side wall to adjacent the right side wall.

29. The container of claim 19 further comprising a slot formed in the slider; and wherein the first switch extends through the slot.

30. The container of claim 19 further comprising a slot formed in the slider; and a fastener extending through the slot to slidably secure the slider to the frame.

31. The container of claim 19 further comprising an aperture formed in the slider; and a battery carried by the frame adjacent the aperture.

32. The container of claim 20 further comprising at least one screw which secures the alarm system to the lid.

33. The container of claim 20 wherein the lid has a top wall, a front wall, a back wall, a left side wall and a right side wall;

the lid is pivotally connected to the base by a hinge extending along the back wall of the lid; and the slider extends from adjacent the front wall to adjacent the back wall.

34. The container of claim 20 wherein the lid has a top wall, a front wall, a back wall, a left side wall and a right side wall;

the lid is pivotally connected to the base by a hinge extending along the back wall of the lid; and the slider extends from adjacent the left side wall to adjacent the right side wall.

35. The container of claim 20 further comprising an electric circuit carried by the frame; a first switch carried by the frame; and a slot formed in the slider; wherein the first switch extends through the slot.

36. The container of claim 20 further comprising a slot formed in the slider; and a fastener extending through the slot to slidably secure the slider to the frame.

37. The container of claim 20 further comprising an aperture formed in the slider; and a battery carried by the frame adjacent the aperture.

* * * * *